US007409800B2

(12) United States Patent
Budge

(10) Patent No.: US 7,409,800 B2
(45) Date of Patent: Aug. 12, 2008

(54) STRUCTURAL THERMAL FRAMING AND PANEL SYSTEM FOR ASSEMBLING FINISHED OR UNFINISHED WALLS WITH MULTIPLE PANEL COMBINATIONS FOR POURED AND NONPOURED WALL

(75) Inventor: Paul W. Budge, St. George, UT (US)

(73) Assignee: JenTec Industries, Inc., St. George, UT (US)

( * ) Notice: Subject to any disclaimer, the term of this patent is extended or adjusted under 35 U.S.C. 154(b) by 0 days.

(21) Appl. No.: 10/732,100

(22) Filed: Dec. 10, 2003

(65) Prior Publication Data

US 2004/0118069 A1 Jun. 24, 2004

Related U.S. Application Data

(63) Continuation of application No. 10/658,649, filed on Sep. 9, 2003, now Pat. No. 6,880,304, which is a continuation of application No. 09/938,713, filed on Aug. 23, 2001, now abandoned.

(60) Provisional application No. 60/197,039, filed on Aug. 23, 2000.

(51) Int. Cl.

| | |
|---|---|
| ***E04B 2/62*** | (2006.01) |
| ***E04B 2/40*** | (2006.01) |
| ***E04B 2/86*** | (2006.01) |

(52) U.S. Cl. ..... 52/241; 52/274; 52/435; 52/481.1; 52/779

(58) Field of Classification Search ..... 52/275, 52/276, 278, 279, 562, 426, 383, 568, 442, 52/427, 429, 309.8, 309.9, 309.7, 309.11, 52/309.12, 284, 281, 779, 777, 780, 270, 52/731.9, 731.8, 731.7, 731.1, 241, 243, 52/309.15, 481.1, 483.1, 479, 274, 435

See application file for complete search history.

(56) References Cited

U.S. PATENT DOCUMENTS

| | | | | |
|---|---|---|---|---|
| 3,733,755 | A * | 5/1973 | Butler | 52/36.6 |
| 3,744,194 | A * | 7/1973 | Ramberg | 52/378 |
| 4,114,333 | A | 9/1978 | Jones et al. | |
| 4,161,087 | A | 7/1979 | Levesque | |
| 4,163,349 | A | 8/1979 | Smith | |
| 4,459,790 | A * | 7/1984 | Vermillion | 52/764 |
| 4,720,948 | A | 1/1988 | Henley et al. | |
| 4,888,931 | A | 12/1989 | Meilleur | |
| 4,967,528 | A | 11/1990 | Doran | |
| 5,099,628 | A | 3/1992 | Noland et al. | |

(Continued)

*Primary Examiner*—Richard E. Chilcot, Jr.
*Assistant Examiner*—Gay Ann Spahn
(74) *Attorney, Agent, or Firm*—Holme Roberts & Owen LLP

(57) ABSTRACT

A structural thermal framing and panel system for assembling finished or unfinished walls with multiple combinations for poured and nonpoured walls. The system includes a permanent structural framing stud which can be adjusted to different wall thickness, a plurality of permanent forms, wherein the pluralities of permanent forms are interchangeable with various other permanent panel forms with or without defined spaces for receiving filler. The framing stud substantially conforms to a portion of the pluralities of panel forms and resists bending in the panel forms. The framing stud is the main structural element in the wall. A structural framing system in combination with insulated panel forms with various defined spaces for receiving filler, and wherein panels may not be prefinished to form a rigid substrate.

8 Claims, 12 Drawing Sheets

U.S. PATENT DOCUMENTS 5,279,089 A 1/1994 Gulur
5,311,718 A 5/1994 Trousilek
5,335,472 A * 8/1994 Phillips ..... 52/742.14
5,390,459 A 2/1995 Mensen
5,456,444 A 10/1995 Wegman
5,459,970 A 10/1995 Kim
5,570,552 A 11/1996 Nehring
5,649,401 A 7/1997 Harrington
5,704,180 A 1/1998 Boeck
5,809,726 A 9/1998 Spude
5,882,540 A 3/1999 Farrington
5,992,114 A * 11/1999 Zelinsky et al. ..... 52/426
6,026,620 A * 2/2000 Spude ..... 52/275
6,176,053 B1 * 1/2001 St. Germain ..... 52/232
6,250,033 B1 * 6/2001 Zelinsky ..... 52/275
6,263,628 B1 * 7/2001 Griffin ..... 52/309.12
6,293,068 B1 * 9/2001 Harrington, Jr. ..... 52/426
6,401,417 B1 * 6/2002 Leblang ..... 52/481.1
6,622,452 B2 * 9/2003 Alvaro ..... 52/742.14
6,625,947 B1 * 9/2003 Burgett ..... 52/424
6,698,710 B1 * 3/2004 VanderWerf ..... 249/216
6,739,102 B2 * 5/2004 Roy, Sr. ..... 52/294

* cited by examiner

STRUCTURAL THERMAL FRAMING AND PANEL SYSTEM FOR ASSEMBLING FINISHED OR UNFINISHED WALLS WITH MULTIPLE PANEL COMBINATIONS FOR POURED AND NONPOURED WALL

CROSS REFERENCE TO RELATED APPLICATIONS

This application is a continuation of application Ser. No. 10/658,649, filed Sep. 9, 2003, now U.S. Pat. No. 6,880,304, which is a continuation of Ser. No. 09/938,713, filed Aug. 23, 2001, now abandoned, both entitled "Structural Thermal Framing and Panel System for Assembling Finished or Unfinished Walls with Multiple Panel Combinations for Poured and Nonpoured Walls," and to Provisional Application Ser. No. 60/197,039, filed Aug. 23, 2000 all of which are incorporated herein in their entirety, and to which priority is claimed.

BACKGROUND OF THE INVENTION

1. Field of Invention

This invention relates in general to a building system for residential and commercial buildings. Specifically, to permanent, thermal panel forms for poured and nonpoured walls in combination with high strength thermally efficient structural framing members or studs.

2. Description of Prior Art

Prior art, traditionally concrete walls are built by erecting wooden or metal forms into which concrete is poured. These forms are structurally rigid and, when properly secured, produce a straight wall. Once the concrete has hardened, the forms are removed and either discarded or moved to the next construction site. Concrete, however, does not provide the most efficient thermal barrier, nor does it provide a suitable surface for attaching interior sheet rock and wall boards or exterior siding and facades. Erection and removal of these large heavy forms is a labor intensive procedure and transportation costs for moving the forms from one construction site to another is expensive. Most prior art building structures use large amounts of concrete and have elaborate engineered steel frames. Whereas, my invention uses minimal amounts of concrete in combination with other building materials and the steel frame having the ability to be adjusted to accommodate different wall widths and is used for the permanent support for the structural thermal framing and panel system.

Another type is an insulated, poured concrete wall having internal and external insulation, drywall or other surface preparation connecting areas which are continuous of and extending the entire or selected lengths of the wall and apparatus for the provision of windows into the wall. This is elaborate and more expensive than my invention. Whereas, my invention has fewer parts to assemble making it more cost effective.

Another type is a method for constructing a wall of a building includes the steps of providing a footing form to outline a horizontal dimension for the wall. Having a wall form ring material between opposing sides of the footing form and allowing the poured wall forming material to set to provide a wall base. Having a first wall and a second wall being opposite to the first wall forming an upright structure forming a wall. This system is more elaborate and more expensive than my invention. This prior art system lacks the ability to adjust to a multi-width whereas, my invention has the ability to adjust making different width walls by adjusting the steel frame.

Another type is a building form system and apparatus including T shaped and U-shaped lengths of extruded plastic or steel coupled at their sides by rigid links. The links are preferably coupled at ninety degree angles along the lengths of the T-shaped and U-shaped elongated members. This system has more assembled parts than my invention making it more costly and it takes more assembly time.

Another type is a concrete form system having plurality of foam panels which are interlocked transversely, horizontally and vertically by a plurality of connectors. This system is very expensive in comparison to my invention.

Another type is a prefabricated wall forming structure for constructing reinforced concrete wall employs insulating foam plastic panels that are interlocked into two parallel concrete impervious walls by I-beam channels that are spaced apart by tie elements. The tie elements can support horizontal or vertical reinforcing bars and prevent the foam wall from spreading apart under the hydraulic pressure of the poured concrete. This system has more parts to assemble than my invention making more costly assembly and this system lacks the ability to be adjustable. My invention has an adjustable frame giving it the ability to adjust to different widths.

Another type is a modular wall construction system includes a box-like block form of expanded foam plastic material such as polystyrene having opposite, parallel, spaced apart side walls and end walls extending between upper and lower surfaces and defining an internal cavity for receiving concrete slurry. This system takes more concrete to form the internal wall making it more expensive and less versatile than my invention.

Another type is a concrete structure made from precast concrete structures. Having an outer wall and an inner wall forming an inter-region between the walls allowing reinforcing concrete to be added. This is an elaborate system which is more costly than my invention.

Another type is a wall form assembly having a pair of form wall assemblies which are kept in preselected spaced parallel relationship by means of cross members fitted within end slots and interlocked by means of pins with elongated braces mounted for movement from a low profile position for transport to a high profile operative position in which the width dimension is transverse to the plane of the form wall for maximum resistance to bowing from the hydrostatic pressure of wet concrete. This is a system for forming a wall than a wall itself. Whereas, my invention is a wall system which becomes the wall itself and has a framing stud which has the ability to adjust for different widths of wall. My invention has very small amounts of concrete needed in combination with different types of building materials.

Another type is a building component comprising first and second high density foam panels each having inner and outer surfaces, top and bottom, and first and second ends, the panels arranged in spaced parallel relationship with their inner surfaces facing each other, and at least two bridging members extending between and through and molded into the panel members, each bridging members comprising a pair of elongated end plates oriented in the top to bottom direction of the panels and abutting against the outer surfaces of the panels, and at least one web member extending between and rigidly connected to the end plates, each web member oriented in the top to bottom direction of the panels and having a height substantially less than the height of the panels. This system requires a large amount of concrete to construct the interior part of wall whereas, my invention takes less concrete in forming the interior part of the wall and my invention has the ability to be adjusted to different widths since the reinforcement frame has an adjustment feature allowing it to be of different widths.

Another type is a multi-component modular system for use in fabricating wall structures of the type which may be fortified with concrete or other similar materials. This system has no adjustable feature for different widths where, my invention does. My invention has a support frame which can be adjusted to different widths, therefore, one framing stud can be adjusted to multi-width wall thickness, thereby, having a multi use.

Another type is a masonry structure reinforcing and confinement apparatus is disclosed for enhancing the structural integrity under stress of masonry structures formed of a plurality of stacked masonry units. This system is for a masonry system only. My invention is for a wall forming system, therefore, my invention is not a masonry system.

Another type is a construction block to be used with other similar blocks in order to construct panels of a building which is formed of a pair of substantially planar panels located in juxtaposition and spaced apart forming a space between the panel. This system is a block system whereas, my invention is a panel system.

Another type is an insulating form work for casting a concrete wall, the form work having a pair of side walls, each of which is made up of a plurality of coplanar edge-abutting modular panels made of insulating foam material. Each panel has upper and lower edges with coplanar slits provided there along, and a pair of vertical end edges respectively provided with a tongue-and-groove to form vertical tongue-and-groove joints with other like adjoining panels. This system has a first group of angle-irons having vertical branches fitting into the upward slits of the panels and horizontal branches pierced with holes extending toward the panel inner face. The panels are also interconnected by a second group of angle-irons having vertical branches fitting into the downward slits of the panels and horizontal branches also pierced with holes extending toward the panel inner face and overlapping the horizontal branches of the angle-irons of the first group. The holes register together and the tie-rods hold the side walls together. The tie-rods have a central portion between the side walls and bent end portions extending through the panels. Elbows between the portions fit into the rabbets. This system does not have the ability to be adjusted to various widths whereas, my invention has this ability making it more versatile, also, less labor intense.

Another type is a modular synthetic plastic concrete form structure for forming a concrete wall or free form or an enclosure having a curved corner. The side panels are positioned in spaced opposed relation. Ties connect the panels in transversely spaced relation and with the panels and the ties being permanently attached with the concrete poured between the panels as a reinforcing and heat insulator. This system has ties that are not able to be adjusted to various widths by using the same framing stud for all different wall thickness, which makes my invention more unique.

Another type is a prefabricated module comprising a three-dimensional armature formed by welded wires and flat elements from light and/or heat-insulating material, retained on either side of the armature to form at least one continuous panel. This system is very complex because of all the welded wires going vertical and horizontal. Because of the complex wire system involved, it's very labor intense making it costly to assemble whereas, my invention is more simplistic making it less labor intense and less costly. Also, my invention, having the adjustable feature that the same framing stud can be used for different width walls, makes my invention novel.

Another type is it has vertical members set in a common base each having spaced pairs of flanges with vertical recess between the flanges of each pair receiving and retaining fastening means by which plasterboard sheets are secured, in spaced relation to the vertical members and defining a molding cavity between metal foil on the facing surfaces of the sheets a core of no-fines concrete being set in said cavity. This system has no adjustable framing studs that can be adjusted to various widths for wall width whereas, my invention has a framing stud that has the ability to be adjusted so the same framing stud can be used for various width walls, which makes my invention unique.

Another type is a wall unit assembly having a steel skeleton frame which cannot be adjusted but is rigid whereas, my invention is adjustable so the same framing stud can be used for various width walls, which makes my invention unique because of the adjustable feature.

BRIEF SUMMARY OF THE INVENTION

Accordingly, besides the objects and advantages described above, several objects and advantages of the present invention are:

(a) to provide for an improved thermal-efficient, cost effective permanent wall framing and wall forming system.
(b) to provide for an improved wall forming system which holds the building panels in a desired position so the resultant wall is straight.
(c) to provide a permanent frame stud producing a finished wall which has much greater structural integrity than previous wall forming systems.
(d) to allow pluralities of forms or building panels define a space for receiving filler.
(e) to provide a framing stud that will resist bending in the wall.
(f) to provide a framing stud which is the substantial structural component in a filled or unfilled finished wall.
(g) to provide a permanent framing stud that allows the erection of a solid single panel form for pouring just a concrete header and poured corners, or panels that form a post and beam matrix concrete structure.
(h) to provide a panel with no defined spaces for receiving filler and is solely a steel framed wall.
(i) to provide for a specially designed and engineered framing stud which has a rigid center webbing and rigid outer flanges, this combination forms a structural stud with truss type strength.
(j) to provide when this structural stud is used in combination with concrete the structural properties of the stud is further improved.
(k) to allow the concrete to form around the structural webbing thereby becoming a part of the webbing. This webbing is connected to a rigid inner and outer cord or flange that is offset from the outer edge of the concrete, thus moving the compression and tension zone out from the center axis point.
(l) to allow the structural formed stud in combination with a thin concrete wall to be comparable in overall strength to a much thicker concrete wall.
(m) to provide for better seismic properties for the overall wall.
(n) to allow all panels or panel forms in this system to be prefinished on the exterior facings prior to delivery.
(o) to provide improved shear strength of the panel.
(p) to provide a keyed grooving process that allows the user the ability to easily modify the panel by sliding filler pieces in between two panel forms thereby allowing the panel the ability to form walls in various thickness and the ability to pour filler in defined areas within the panel to form posts and beams or to form openings in the poured wall for windows and doors.

(q) to provide multiple flange receptacle grooving or slots on both ends of the panel allowing for even more pour combinations and the ability to form various thickness of walls with one combination panel.

(r) to provide a framing stud with an adjustable feature allowing the frame support to adjust to various widths thereby one framing stud will fit various walls having different width thickness.

(s) to provide bend out stud brackets that are part of the framing for holding horizontal and/or vertical rebar in a desired configuration, thereby these brackets add structural strength to the webbing of the stud frame.

(t) to provide bend out brackets which are part of the framing stud for fastening to footings or other substrates without the use of "L", "C", or "U" channels.

It is an object of the present invention to provide an improved structural thermal framing panel system for assembling finished or unfinished walls with multiple panel combination for poured and nonpoured walls.

Other objects and features are readily apparent from the following description of certain preferred embodiments thereof taken in conjunction with the accompanying drawings although variations and modifications may be affected without departing from the sphere and the scope of the normal concepts of the disclosed invention. You will find further objects and advantages of the invention from a consideration of the ensuing descriptions and accompanying drawings.

DRAWING REFERENCE NUMERALS

Figure 1:
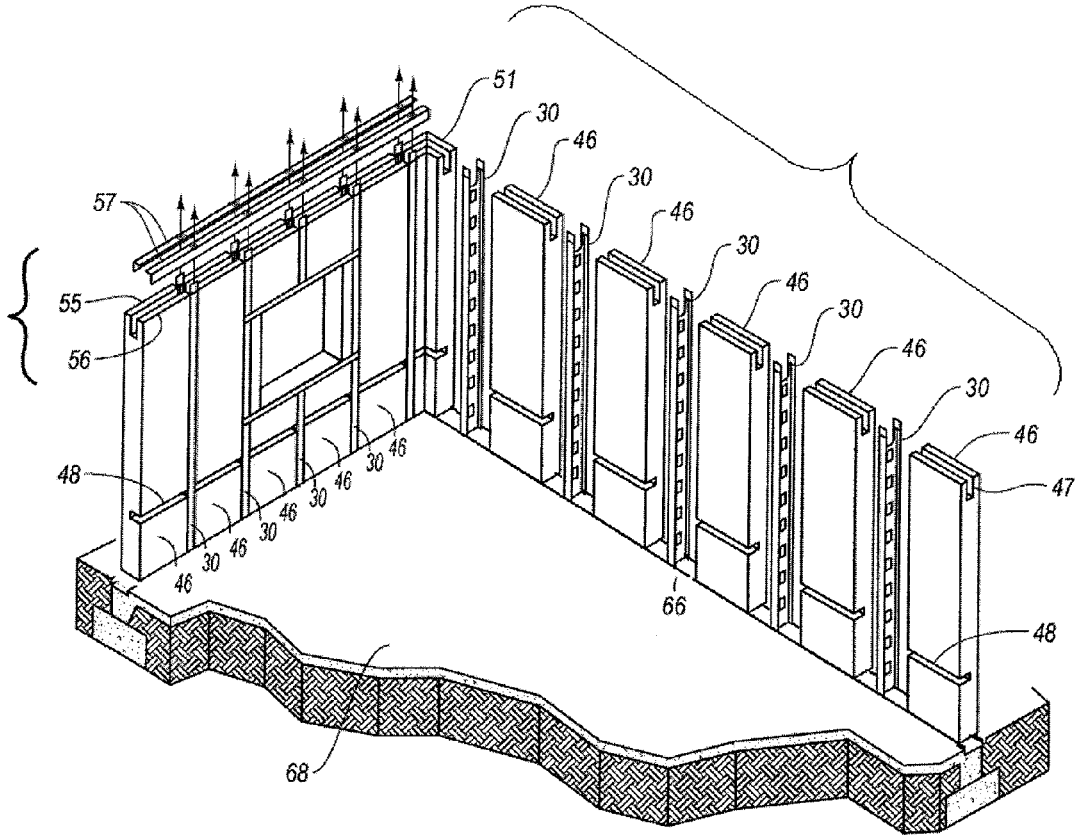
FIG. 1 illustrates a perspective break-out view of the thermal steel framing stud and insulated panel assembly.
Figure 2:
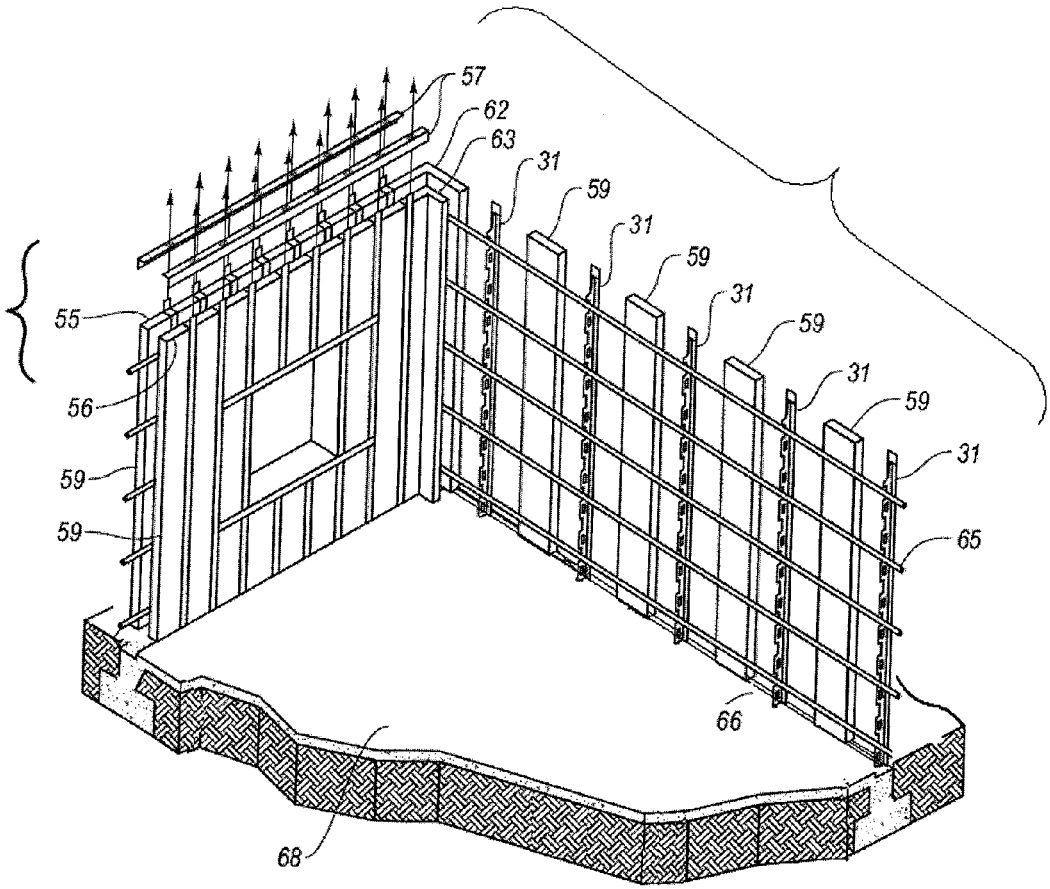
FIG. 2 illustrates a perspective break-out view of the steel framing stud and insulated concrete panel assembly. In the right hand side of FIG. 2 the near side of the wall has been removed to better illustrate the wall structure.

21 The structural thermal framing and panel system for assembling finished or unfinished walls with multiple combinations for poured and nonpoured walls
30 framing stud assembly
31 first end
32 second end
33 web first end
34 web second end
35 flange first end
36 flange second end
37 slotted interlock receiver hole second end
38 interlock tab first end
39 top tab first end
40 top tab second end
41 bottom tab first end
42 bottom tab second end
43 rebar holder second end
44 electric utility hole first end
45 electric utility hole second end
46 straight insulated panel
47 top groove for header
48 groove for electric utility conduit
49 slot for framing stud flange
50 inset area for framing stud flange
51 outside 90 degree corner insulated panel
52 inside 90 degree corner insulated panel
53 inside 45 degree corner insulated panel
54 outside 45 degree corner insulated panel
55 top ⊔ shaped header
56 top ⊓ shaped header
57 L shaped slotted connector angle
58 slotted receiver hole for top tab
59 straight thin insulated panel
60 45 degree long corner thin insulated panel
61 45 degree short corner thin insulated panel
62 90 degree long corner thin insulated panel
63 90 degree short corner thin insulated panel
64 concrete filler
65 horizontal rebar

66 L channel
68 footing

DETAILED DESCRIPTION OF THE PREFERRED EMBODIMENTS

Figure 4:
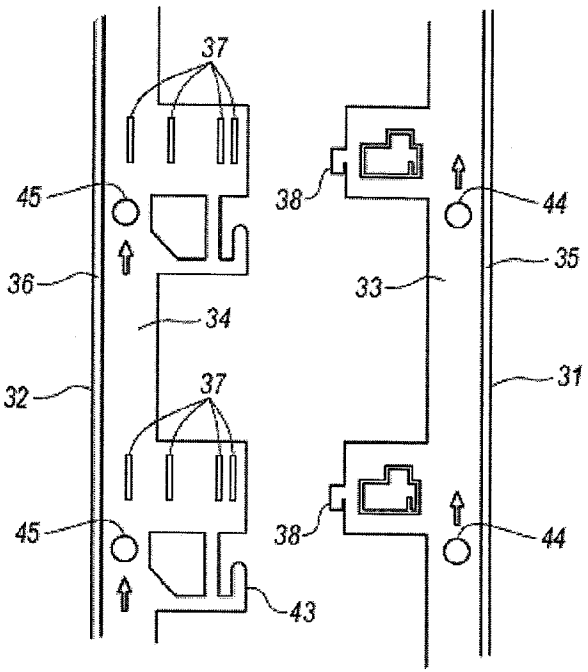
FIG. 4 illustrates a front elevational view of an enlarged section of the framing stud in FIG. 3 and illustrates first and second ends with adjustable means.
Figure 3:
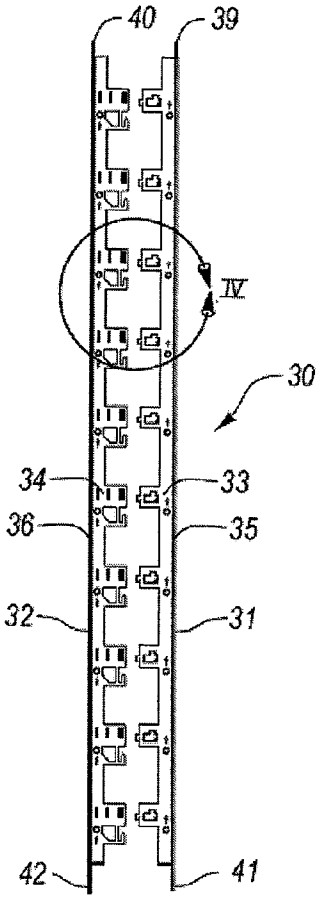
FIG. 3 illustrates a front elevational view of the framing stud.
Figure 5:
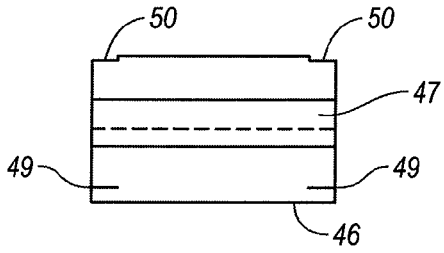
FIG. 5 illustrates a top view of a straight insulated panel.
Figure 6:
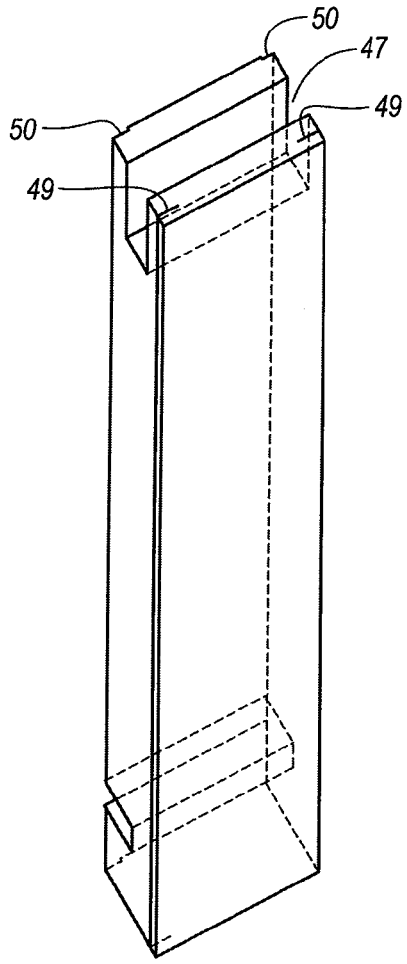
FIG. 6 illustrates a perspective view of a straight insulated panel.
Figure 7:
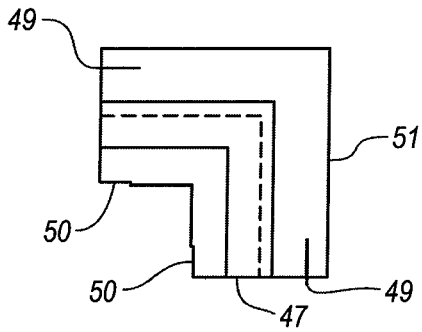
FIG. 7 illustrates a top view of an outside 90 degree corner insulated panel.
Figure 9:
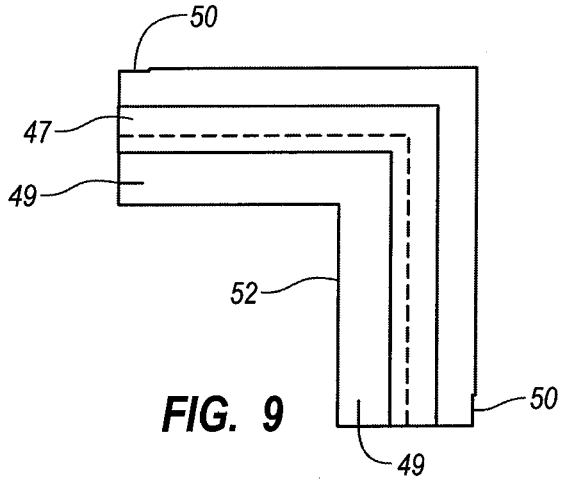
FIG. 9 illustrates a top view of an inside 90 degree corner insulated panel.
Figure 8:
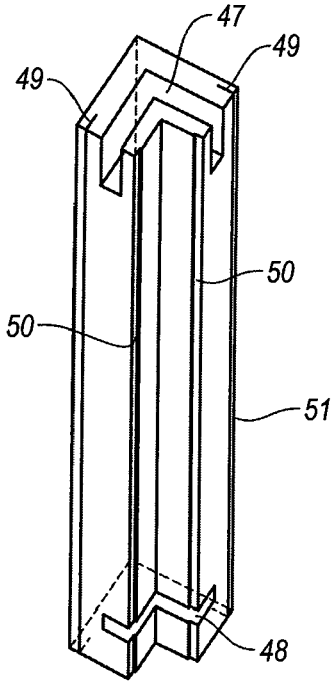
FIG. 8 illustrates a perspective view of an outside 90 degree corner insulated panel.
Figure 10:
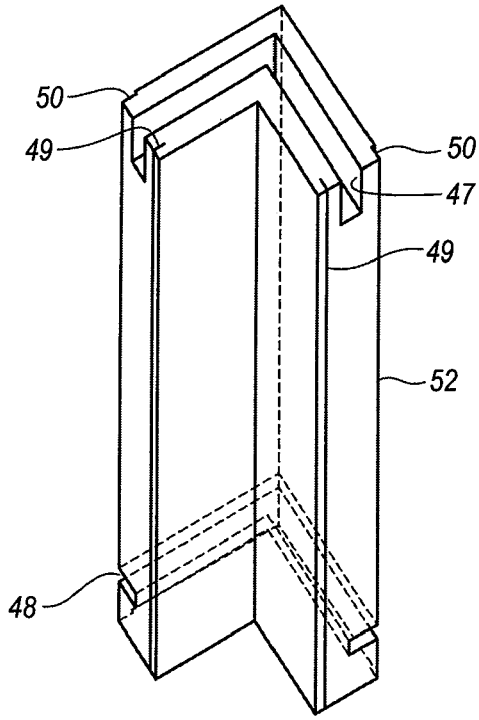
FIG. 10 illustrates a perspective view of an inside 90 degree corner insulated panel.
Figure 11:
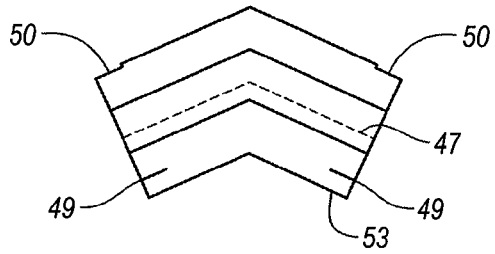
FIG. 11 illustrates a top view of an inside 45 degree corner insulated panel.
Figure 13:
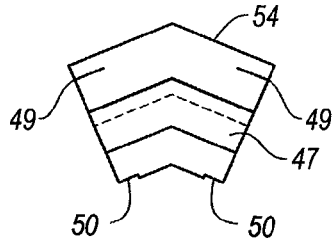
FIG. 13 illustrates a top view of an outside 45 degree corner insulated panel.
Figure 12:
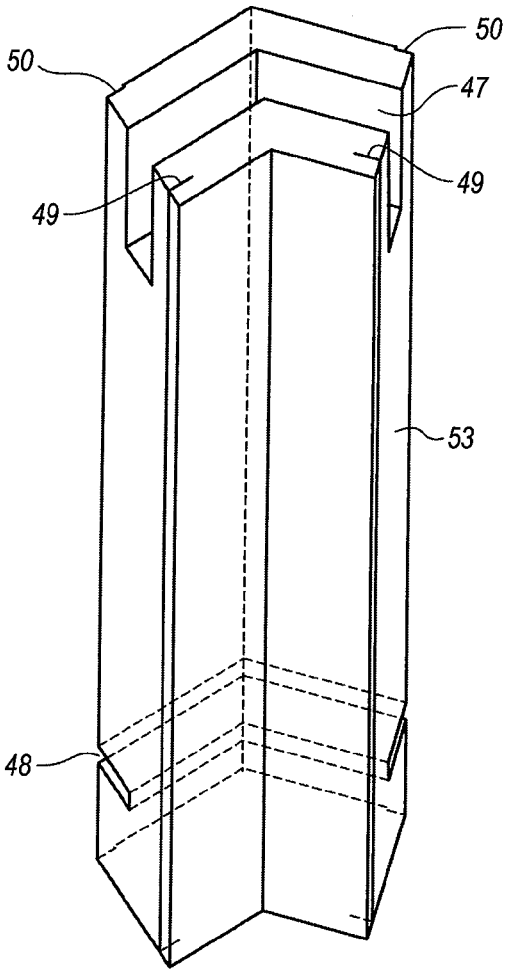
FIG. 12 illustrates a perspective view of an inside 45 degree corner insulated panel.
Figure 14:
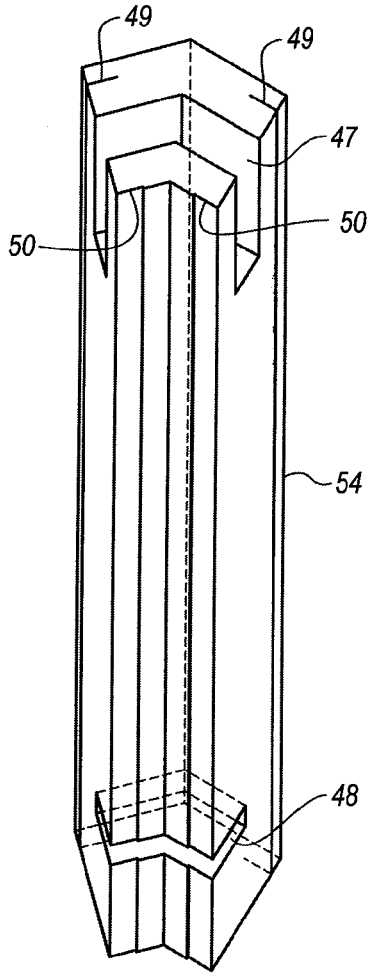
FIG. 14 illustrates a perspective view of an outside 45 degree corner insulated panel.
Figure 15:
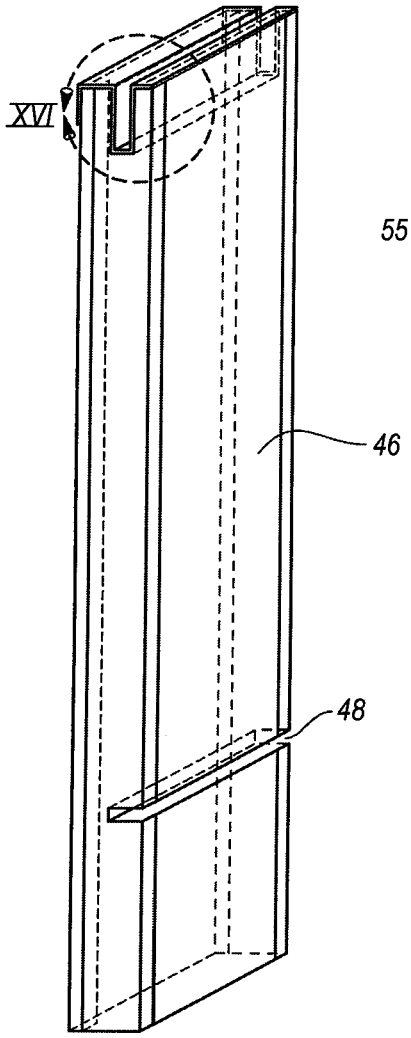
FIG. 15 illustrates a perspective view of a straight insulated panel.
Figure 16:
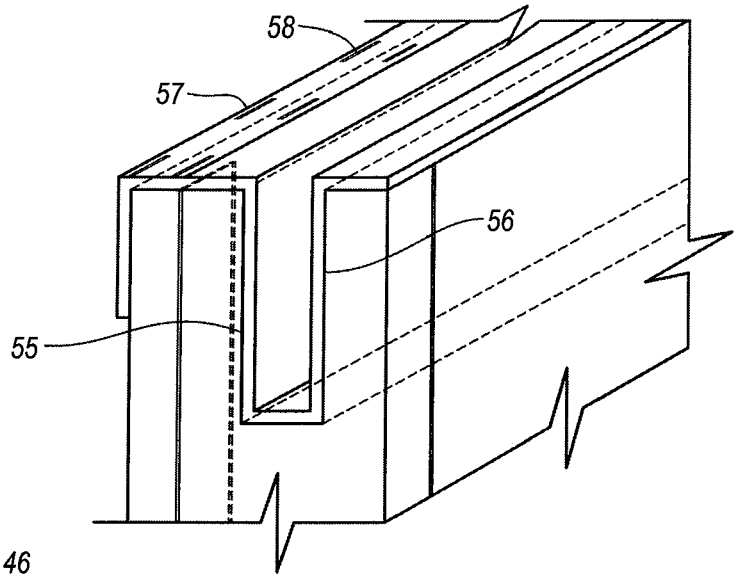
FIG. 16 illustrates a perspective blow-up view top ⊓ and ⊔ shaped headers.
Figure 17:
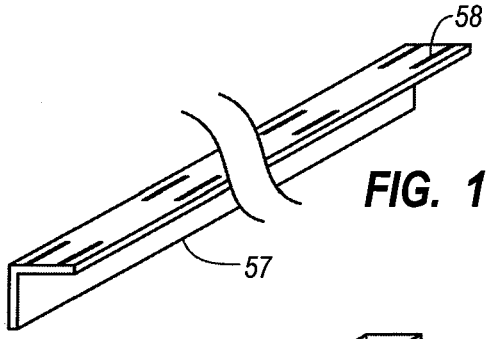
FIG. 17 illustrates a perspective view of a slotted angle.
Figure 18:
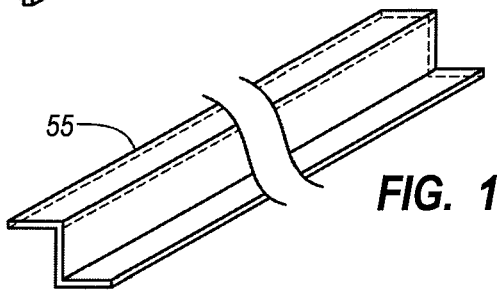
FIG. 18 illustrates a perspective view of a ⊔ shaped header.
Figure 19:
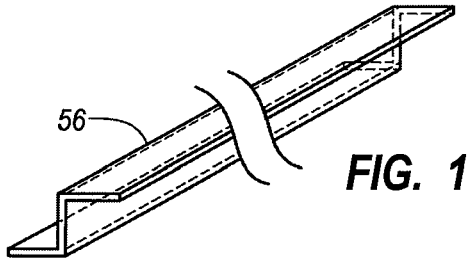
FIG. 19 illustrates a perspective view of a ⊓ shaped header.
Figure 20:
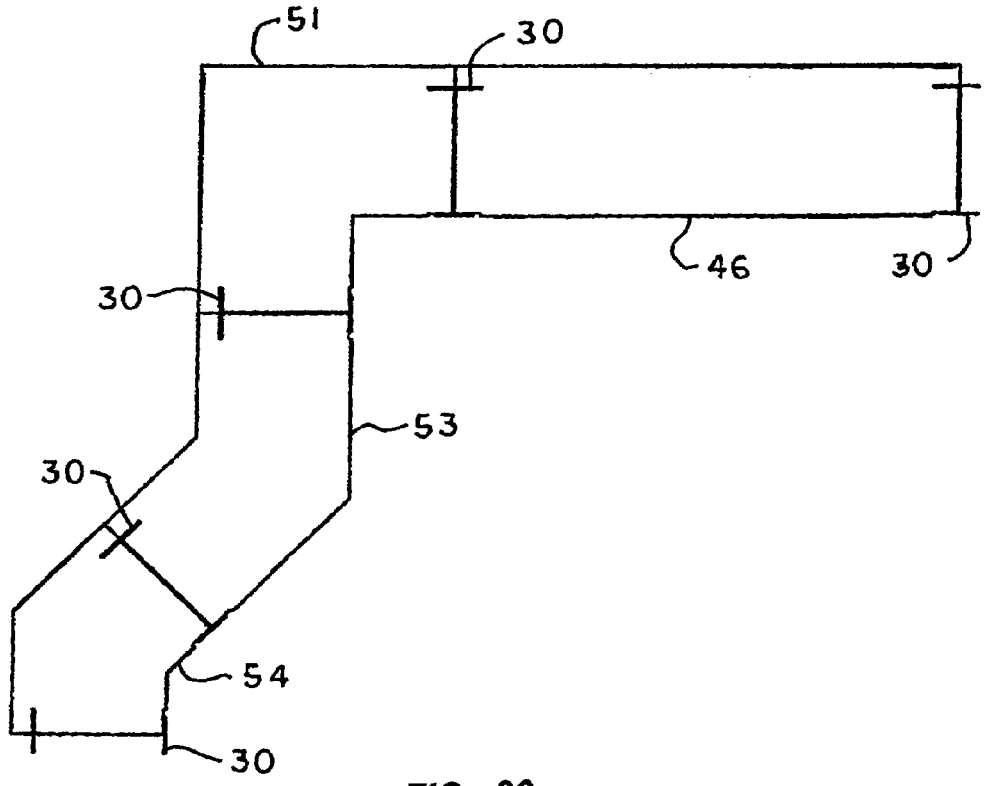
FIG. 20 illustrates a top view of the thermal steel framing stud and insulated panel assembly.
Figure 21:
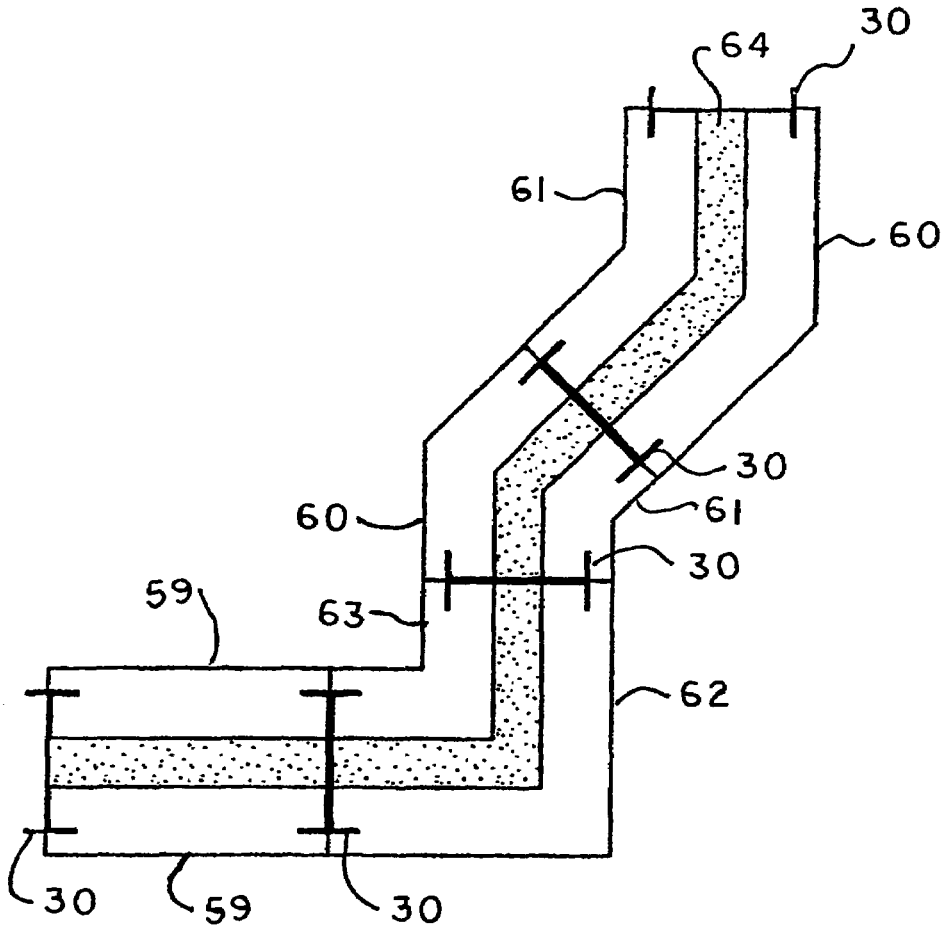
FIG. 21 illustrates a top view of the steel framing stud and insulated concrete panel assembly.
Figure 22:
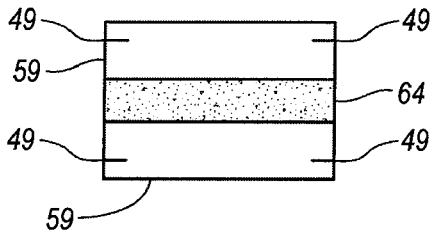
FIG. 22 illustrates a top view of a straight insulated concrete panel.
Figure 23:
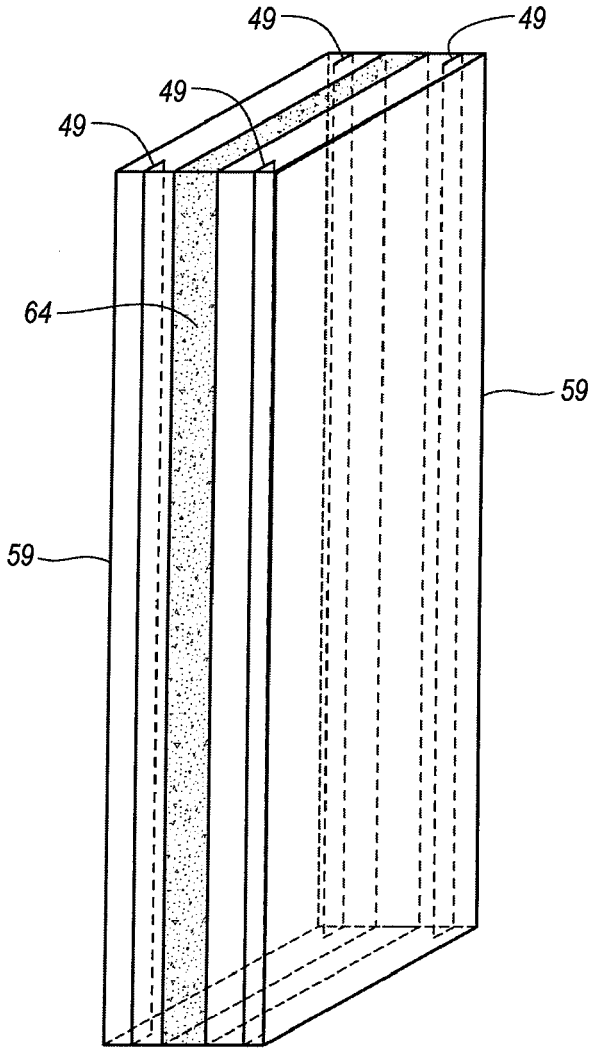
FIG. 23 illustrates a perspective view of a straight insulated concrete panel.
Figure 24:
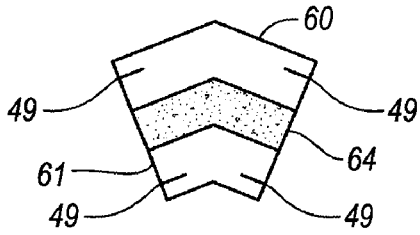
FIG. 24 illustrates a top view of a 45 degree corner insulated concrete panel.
Figure 25:
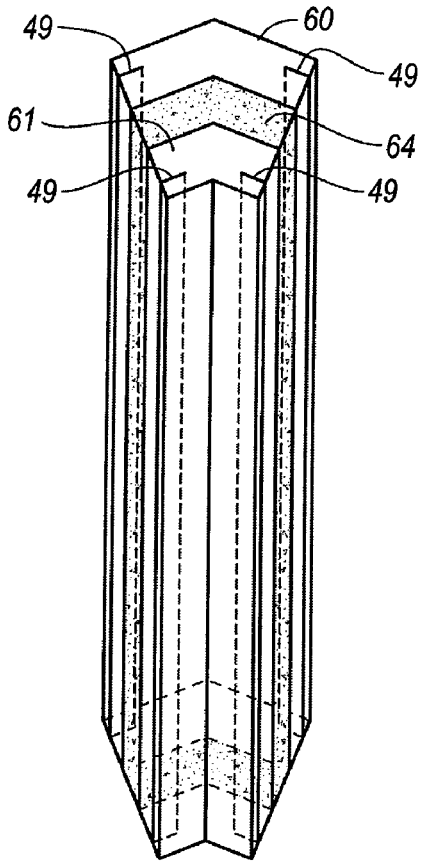
FIG. 25 illustrates a perspective view of a 45 degree corner insulated concrete panel.
Figure 26:
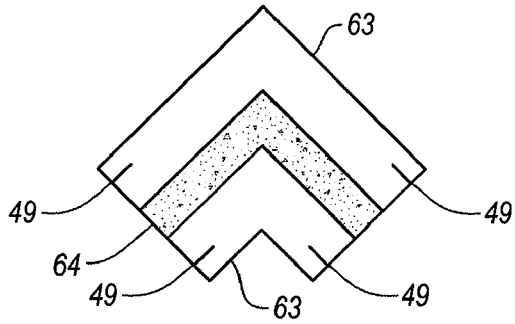
FIG. 26 illustrates a top view of a 90 degree corner insulation concrete panel.
Figure 27:
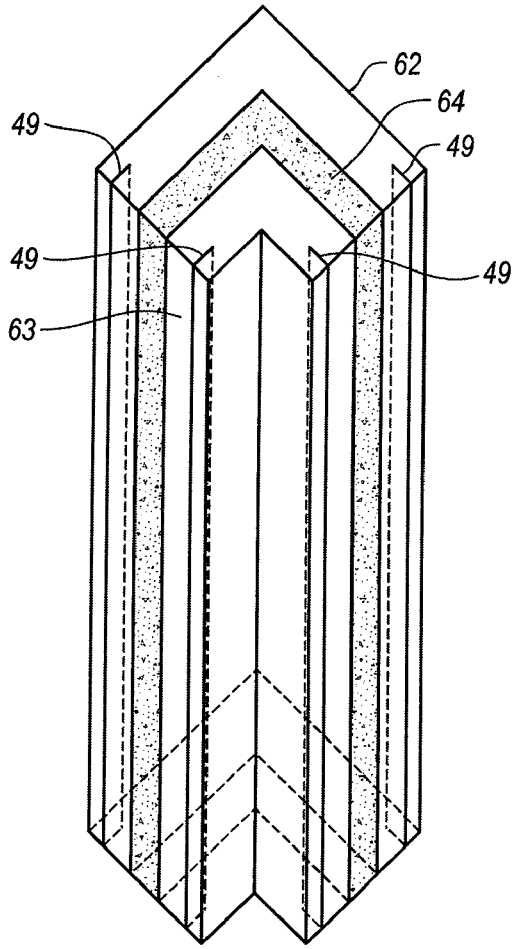
FIG. 27 illustrates a perspective view of a 90 degree corner insulated concrete panel.

The structural thermal framing and panel system for assembling finished or unfinished walls with multiple combinations for poured and non poured wall 29 is shown in FIGS. 1-27. With particular reference to FIGS. 3 and 4, The system includes at least one framing stud assembly 30 having a first end 31 and a second end 32, which are each more generally referred to as a stud element of the framing stud assembly 30. Each part of the structural thermal framing and panel system, including for example the framing stud assembly, has sufficient thickness, width and length for its intended purpose.

The first end 31 of the framing stud assembly 30 has a web 33, a flange 35, at least one interlock tab 38, a top tab 39, a bottom tab 41, and at least one electric utility hole 44 having sufficient area to accommodate electric conduit. The second end 32 of the framing stud assembly 30 has a web 34, a flange 36, at least one slotted interlock receiver hole 37 having sufficient area to accommodate interlock tab 38 of said first end 31, a top tab 40, a bottom tab 42, at least one rebar holder 43 having sufficient area to accommodate required horizontal rebar, and at least one electric utility hole 45 having sufficient area to accommodate electric conduit.

With reference now to FIGS. 1 and 5-14, a structural thermal framing and panel system with multiple panel combinations for nonpoured wall includes at least one framing stud assembly 30 and at least one straight insulated panel 46. The structural thermal framing and panel system can also include at least one outside 90 degree corner insulated panel 51, inside 90 degree corner insulated panel 52, inside 45 degree corner insulated panel 53, and/or outside 45 degree corner insulated panel 54. All of said panels 51, 52, 53, 54 have a top groove 47 having sufficient area to accommodate ⊓⊔ shaped header 55, ⊔⊓ shaped header 56, and/or at least one L shaped slotted connector angle 57, which has multiple slotted received holes 58 to accommodate top tab 39 and top tab 40. The panels 51, 52, 53, 54 also have a groove 48, which has sufficient area to accommodate electric utility conduit. The panels 51, 52, 53, 54 also have slot 49 in sufficient area to accommodate said framing stud flange 36 and inset areas 50 having sufficient area to also accommodate the framing stud flange 36.

With reference to FIGS. 2, 3, and 22-27, another example structural thermal framing and panel system is illustrated. This example system has multiple panel combinations for poured wall including at least one framing stud assembly 30 and at least two straight thin insulated panels 59. This example system can also include at least one 45 degree long corner thin insulated panel 60, 45 degree short corner thin insulated panel 61, 90 degree long corner thin insulated panel 62, and/or having 90 degree short corner thin insulated panel 63. Said panels 59, 60, 61, 62, 63 have concrete filler 64 having sufficient thickness, width and length between said panels. The structural thermal framing and panel system for assembling finished or unfinished walls with multiple panel combinations for poured and nonpoured walls 29 can include materials that may be made from concrete, stone, brick, foam, plastic, wood, iron, steel, aluminum or any other type metal, polyurethane type composite with fiber glass, high density expanded polystyrene, plastic or any combination of these materials.

A structural thermal framing and panel system is provided for assembling finished or unfinished walls with multiple panel combinations for nonpoured walls. The structural thermal framing and panel system includes at least one framing stud assembly and at least one straight panel. The structural thermal framing and panel system can also include at least one outside corner panel and/or at least one inside corner panel. Each corner panel can be insulated and can have a bend of about 90 degrees or about 45 degrees. The structural thermal framing and panel system can also include at least one top header, and at least one L shaped slotted connector angle and at least one slotted received hole for the top tab. The top header can be ⊓⊔ shaped or ⊔⊓ shaped.

The framing stud assembly can include a first end with a web, a flange, at least one interlock tab, a top tab, a bottom tab, and at least one electric utility hole having sufficient area to accommodate electric wires. The framing stud assembly can also include a second end with a web, a flange, at least one slotted interlock receiver hole having sufficient area to accommodate the interlock tab located on the first end and allowing the interlock tab to firmly hold the first end to the second end, a bottom tab, at least one electric utility hole having sufficient area to accommodate electric wires, and at least one rebar holder for holding at least one horizontal rebar.

The straight panel can include a top header, a top groove having sufficient area to accommodate the top header, at least one L shaped slotted connector angle having at least one slotted receiver hole to accommodate the top tab located on the framing stud top surface, and inset area locations having sufficient area to accommodate the flange located on the framing stud assembly. The inset area and the slot are used to locate the framing stud assembly on the straight panel.

The corner panel can include a top header, a top groove having sufficient area to accommodate the top header, at least one L shaped slotted connector angle having at least one slotted receiver hole to accommodate the top tab located on the framing stud top surface, inset area locations having sufficient area to accommodate the flange located on the framing stud assembly, and slot locations for the flange on the framing stud assembly. The inset area and the slot are used to locate the framing stud assembly on insulated panels.

The straight insulated panel can also include at least one corner thin panel having a bend of about 90 degrees and configured in a long bend, short bend or a combination of both. The corner thin panel can also have a bend of about 45 degrees. Concrete filler can be placed between the panels.

The panels can also include a slot in locations for the flange on the framing stud assembly. The L shaped slotted connector angle includes at least one slotted receiver hole to accommodate the top tab located on the framing stud top surface. Inset area locations have sufficient area to accommodate the flange located on the framing stud assembly. Slot locations for the flange are provided on the framing stud assembly. The inset area and slot are used to locate the framing stud assembly on the straight thin insulated panel and the corner thin panel.

The top tab is bent at an angle of about 90 degrees after being received through the slotted received hole in the L shaped slotted connector angle. Additionally, the bottom tab is bent at an angle of about 90 degrees to be used to attach the framing stud assembly to the footing. The framing stud assembly can also include at least one interlock tab located on the first end and at least one interlock receiver hole located on the second end allowing the framing stud assembly to be adjusted to various wall widths.

In another embodiment of the present invention, interior forms, exterior forms or panel forms are supported by stud frames. The forms or panel forms can be arranged to defined a space for receiving filler materials. The filler material includes concrete, sand, gravel, portland cement, or any other wall building material known to those skilled in the art. Each stud frame can include an interior form holder and an exterior form holder. The holders can include an outside flange. If the form or forms need to be held in place until the filler is poured, adhesive or fasteners are used to secure the forms to the flange. In the embodiment shown, vertical support or stud frame extend from the top to the bottom of the wall. The two piece support of each stud frame are tied together. To reconnect the stud frame after it is cut in half rebar extends through the interior of the wall and is supported by the bend out brackets.

In another embodiment of the stud frame, the two halves are reconnected by placing rebar in the slot or rebar bracket and the other half of the stud frame is rotated about 180 degrees and hooked to lock the rebar in place, this also locks the two halves together. In an alternative embodiment, the vertical rebar is placed in the space and the horizontal rebar is simply tied to the vertical rebar.

A side view of several stud frames and forms are shown standing an a footing 68. The stud frames are connected to the footing 68 by fastening tabs or L channels 66. One embodiment includes two lengths of angle sheet metal or iron which are secured to the footing 68 by concrete nails or bolts. The stud frames are then connected to the anchor by metal screws. In alternative embodiments, the stud frames are secured to the anchors by welding or any other means known to those skilled in the art. In a further embodiment, no anchors are necessary because the stud frames are fastened to the footing 68 with the fastening tabs on the stud frame or they can be set in the footing 68 while the concrete of the footing 68 is still wet.

In another embodiment, a standard eight foot wall comprises two three inch thick forms and a six inch concrete core for a total wall thickness of twelve inches. Note forms and stud frames come in various thicknesses, widths, and heights for various applications and may also be pre assembled into bigger sections or as complete walls prior to delivery to the job site. The stud frames are vertically positioned approximately one to four feet apart, or other effective spacing. The stud halves 10 of the stud frame are approximately two inches wide and the outside flanges are spaced six to twenty four inches apart. The connections are spaced six to twelve inches, one above the other. The connections of stud frames can be made from galvanized steel and connected by spot welding or other known methods of connection. The stud frames can alternatively be connected by hook brackets that can hook to each other or to the rebar. The forms can be made of expanded polystyrene (EPS) having variable densities. The form types are cut, extruded, or molded from standard EPS or other types of expanded light weight materials which have preferably been treated with flame and smoke retardants and treated to resist insects. Specifically, sheets of expanded polystyrene can be obtained, for example, from AFM Corporation, P.O. Box 246, Excelsior, Minn. 55331, or one of its affiliates. Compared to a twelve inch thick solid concrete wall, which has an R rating between six and eight, the above-described wall's have an R rating of approximately twenty-five to seventy-five depending on panel type and configuration used.

In a further embodiment, the stud frame includes one piece of sheet metal that is cut, formed, and connected into a one piece structural element capable of supporting several thousand pounds. However, only a single connection is placed at the top of each stud frame to tie the stud halves together. Thus, in this embodiment, the supports are secured at the bottom by the anchors and at the top by a connection.

An alternative embodiment is shown wherein the stud frame comprises a single one piece stud frame. The stud frame is positioned in the center of the space for receiving wall filler material. In further alternative embodiments, the stud half of the form is positioned at the interior form, the exterior form, or anywhere between. The connections are attached to the support and form holders include outer flanges. Alternative embodiments have three or more supports per brace, depending on the particular application.

The forms are arranged in a vertical orientation. One form is supported vertically by a stud frame or in other forms a stud frame supports two panel forms. In further alternative embodiments, the stud frames have stud halves which are oriented horizontally to provide support to the forms. This is particularly advantageous where a curved or sloping wall is to be constructed. The stud halves are also positioned at various angles depending on the particular application.

In a retaining wall application of the present invention, each stud frame comprises a single support. The stud half also includes one set of holders for holding a single set of forms. A trench is cut in the ground and the forms are assembled so the forms are opposite a wall of earth wherein the space for fillers is defined between. Struts extend from the stud half of each stud frame into the wall of earth to steady the studs.

In a process for assembling the wall forms, the footing of the foundation is first poured. Once the footing has solidified, anchors are secured to the footings. Next, a stud frame is placed upright on the footing and secured to the anchors. In some panels an exterior form can then be connected to the first stud frame. Similarly, an interior form can also be connected to the first stud frame at a position opposite to the exterior form. A space for receiving filler is thereby defined between the forms. A second stud frame is then placed upright on the footing and secured to the anchors. The second stud frame is then connected to both the interior and exterior forms. Additional stud frames and forms are then added until the entire wall forms are properly in place. Other panels are connected in a similar fashion. The tops of the stud frames are then connected to each other to provide more stability. Finally, rebar is inserted between the interior and exterior form and placed through the rebar positioners of the struts.

Once the forms are properly in place, the wall is formed by pouring filler into the forms. A process for this procedure is accomplished by pouring the filler into the bottom portion of the forms. In most embodiments, the depth of the filler should only be about two feet along the entire forms. Next, this filler in the bottom portion of the forms is allowed to partially set. Once the filler has begun to harden, additional filler is poured on top of bottom portion of filler. This addition layer of filler should also be approximately two feet deep so that the total height of the filler is now approximately four feet. This additional layer of filler is also allowed to partially set. The pouring and setting is continued until the desired wall height is achieved. In some panel type configurations filler may be poured in continues lifts up to 12 feet.

In another embodiment of the invention, a window is cut in the forms. In this embodiment, a hole is cut in the interior forms and form holders which pass through the window area. Similarly, a hole is cut in the exterior forms and form holders of the braces which pass through the window area. The stud halves and connections are also removed from the window area. In order to prevent filler from flowing out of the holes, a tube is placed in the window to form the circumference of the space. The window, of course, may be practically any shape desired. In one embodiment, the tube comprises sheet metal and has flanges which extend beyond and wrap around the outside of both the interior and exterior forms. In another embodiment, window and door areas are closed off by sliding in filler pieces around the areas that will not be filled. These pieces slide in-between each panel and lock in place due to a keyed grooving process incorporated in the panel form. This allows the user to have the ability to close off various areas of the panel simply by sliding in the filler pieces. Also, this allows one type of panel to be poured to various wall thicknesses. Post and beam combinations or solid unfilled walls can be used with wood or steel type header elements instead of concrete.

In another embodiment of the invention, the filler is poured into the defined spaces in the forms to create the wall. Once the filler has been poured and set, the forms are not removed. Rather, the forms remain a permanent part of the wall to improve the thermal characteristics and structural integrity of the wall.

In further embodiments, channels are cut into either the interior or exterior of the form for installing electrical or plumbing conduits. A channel is cut into a number of exterior forms and spans across several stud frames. Any means may be used to cut the channel into the forms, but where polystyrene forms are used, a curved heating element is particularly useful to melt through the forms. Once the conduits are placed in the channel, a portion of the removed polystyrene is placed back into the channel for maximum thermal efficiency. In alternative embodiments, the slot is any portion of the stud frame which does not present a barrier between the sides of two adjacent forms. For example, the slot can be any portion between the forms which does not have a connection between.

In another embodiment of the invention, a wallboard is attached to the interior or exterior of the formed wall. In this embodiment, the braces comprise wallboard hangers which extend between two adjacent forms. The wallboard hanger includes any suitable material known to those skilled in the art, such as metal, plastic, wood, etc. Further in alternative embodiments, the wallboard hanger does not include a single strip that runs the length of the brace, rather it includes several smaller hangers such that each hanger extends only over a portion of the brace. These smaller hangers are arranged at various locations along the brace between two adjacent forms. In other embodiments, the hangers are embedded in the forms or protruded through holes in the forms. A wallboard can be positioned against the wallboard hangers. Fasteners secure the wallboard to the wallboard hangers. Fasteners include screws, nails, spot welds, rivets, glue, etc. Any type of wallboard may be secured to the wallboard hangers such as sheet rock, wood panels, vinyl siding, metal siding, brick or stone facades, etc. Alternatively, a support mesh is attached to the forms to serve as a support for a stucco surface. In particular, Elastomeric Synthetic Plaster (Stucco) "Perma-Flex" is applied directly to the wall as recommended by El Rey Stucco Company of 4100 Broadway SE, Albuquerque, N. Mex., 87105.

In one embodiment, the member, which serves as the wallboard hanger, serves a dual function: (1) it is a hanger to which fasteners are attached to secure wallboard to the wall; and (2) it is the outer flange which holds the forms.

The width of the supports depends on the weight of the wallboard and the size of the conduits required for the particular application. In embodiments where no conduits are to be embedded in channels of the forms, the supports may be thicker than the forms so they project into the space for the filler. Also, in embodiments requiring heavy wallboard, the supports should be thicker or made of a material having sufficient strength to sustain the wallboard.

Another embodiment of the invention provides forms that are a pre-finished substrate. A desired substrate suitable for the climate where as any or all substrates in use may be applied to forms before delivery. Specifically, a fiber reinforced acrylic modified cement type product can be used on the exterior facing of panels or forms.

CONCLUSION AND SCOPE OF INVENTION

Accordingly, the reader will see that the structural thermal framing and panel system for assembling finished or unfinished walls with multiple panel combinations for poured and nonpoured walls of this invention has the ability to be installed in a fraction of the time compared to masonry or solid concrete walls with about the same or less in total material costs. Furthermore, the structural thermal framing and panel system has the additional advantages in that:

- it provides an improved thermal-efficient, cost effective permanent wall framing and wall forming system which holds the building panels in a desired position so the resultant wall in straight.
- it provides a finished wall which has much greater structural integrity than previous wall forming systems.
- it provides for a permanent stud frame with a plurality of forms or building panels with a defined space for receiving filler, and wherein the framing stud substantially conforms to a portion of the forms or building panels and resists bending in the wall.
- it allows the framing stud web to become part of a rigid inner and outer cord or flange that is offset from the outer edge of the concrete, thus moving the compression and tension zone out from the center axis point.
- it provides comparable in overall strength to a much thicker concrete wall and also has better seismic properties.
- it allows all panels or panel forms in this system to be prefinished on the exterior facings prior to delivery.
- it allows the framing stud assembly to adjust to different wall thickness, so that the same framing stud assembly has multiple use.
- it provides a wall forming system to utilize the structural strength of the framing stud assembly in reducing the amount of concrete and rebar needed to form a structurally sound wall.
- it allows a plurality of permanent panel forms in combinations with or without concrete.
- it provides bottom bend out tabs for holding the framing stud assembly to the footing or floor.
- it provides top bend out tabs for holding the framing stud assembly to the adjoining form panels.
- it allows panels to be precoated with cementitious fiber or wire type reinforced hard coat finish for exterior facing of the forms that can be taped or meshed at the seams and a finished coat.
- it allows the ability to fasten the framing stud assembly to footings or other substrates without the use of "L", "C", or "U" channel usually required by prior art.

Although the description above contains many specifications, these should not be construed as limiting the scope of the invention but merely providing illustrations of some of the presently preferred embodiments of this invention.

Thus, the scope of the invention should be determined by the appended claims and their legal equivalents, rather than by the examples given.

What is claimed is:

1. A wall system, comprising:

a first slotted connector angle having a plurality of slots spaced at a distance from one another corresponding to a desired placement of framing stud assemblies;

a first stud assembly including a first stud element and a second stud element, the first stud element being adjoined directly to the second stud element to provide the stud assembly, each of the first stud element and the second stud element having an upper end and a lower end and further comprising:

a web portion extending from the upper end of the stud element to the lower end of the stud element;

a first flange element connected to the web portion and extending perpendicularly from the web portion;

a second flange element connected to the web portion and extending perpendicularly from the web portion in a direction opposite the first flange element, whereby the first flange of the first stud element is parallel and opposite the first flange of the second stud element and the second flange of the first stud element is parallel to and opposite the second flange of the second stud element; and an upper tab element at the upper end of the stud element, the upper tab element being configured to engage one of the plurality of slots of the first slotted connector angle; and a first wall panel connected to the first flange element of the first stud element such that at least a portion of the first wall panel is positioned between the first flange element of the first stud element and the first flange element of the second stud element.

2. A wall system according to claim 1, further comprising a second stud assembly having at least one upper tab element and being connected to the first wall panel, the first stud assembly, the first wall panel, and the second stud assembly forming a first portion of a wall;

wherein the slotted connector angle attaches to at least one upper tab element of the first stud assembly and at least one upper tab element of the second stud assembly in order to provide additional support to the first portion of a wall.

3. A wall system according to claim 2, further comprising:

a third stud assembly having at least one upper tab element; and a second wall panel connectable to each of the second stud assembly and the second stud assembly to form a second portion of a wall;

wherein the first slotted connector angle is linear and the first portion of a wall is therefore in line with the second portion of a wall.

4. A wall system according to claim 3, further comprising a second slotted connector angle; wherein the first slotted connector angle connects to upper tab elements of the respective first stud elements of the first, second, and third stud assemblies and the second slotted connector angle connects to upper tab elements of the respective second stud elements of the first, second, and third stud assemblies.

5. A wall system according to claim 1, wherein the first stud element further comprises a support element adapted to support horizontal steel reinforcement rods.

6. A wall system according to claim 3, wherein the first stud element of the first stud assembly and the first stud element of the second stud assembly each further comprises a support element adapted to support a horizontal steel reinforcement rod that is positioned to connect the first stud assembly to the second stud assembly.

7. A wall system according to claim 3, further comprising:

a third wall panel connectable to the first flange element of the second stud element such that at least a portion of the third wall panel is positioned between the first flange element of the first stud element and the first flange element of the second stud element; and a layer of concrete formed between the first wall panel and the third wall panel.

8. A wall system according to claim 1, wherein the slotted connector angle is L-shaped.

* * * * *